US006270212B1

(12) United States Patent
Kusumi et al.

(10) Patent No.: US 6,270,212 B1
(45) Date of Patent: Aug. 7, 2001

(54) PRINT HEAD FOR AN INK JET PRINTER

(75) Inventors: Tatsuya Kusumi; Koichi Tanaka, both of Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/277,494

(22) Filed: Mar. 26, 1999

(30) Foreign Application Priority Data

Mar. 27, 1998 (JP) ..... 10-098248

(51) Int. Cl.[7] ..... B41J 2/175
(52) U.S. Cl. ..... 347/93
(58) Field of Search ..... 347/85, 86, 87, 347/93, 92

(56) References Cited

U.S. PATENT DOCUMENTS

| | | | | |
|---|---|---|---|---|
| 4,853,716 | * | 8/1989 | Oda | 347/66 |
| 4,890,126 | * | 12/1989 | Hotomi | 347/45 |
| 5,353,094 | * | 10/1994 | Kagayama | 355/27 |
| 5,558,969 | * | 9/1996 | Uyttendaele et al. | 430/124 |
| 5,616,447 | * | 4/1997 | Arioka | 430/270.11 |
| 6,090,749 | * | 7/2000 | Kowalski | 503/227 |

FOREIGN PATENT DOCUMENTS

| | | |
|---|---|---|
| 0645244 | 3/1995 | (EP) . |
| 0869006 | 10/1998 | (EP) . |
| 0887190 | 12/1998 | (EP) . |
| 4-173345 | 6/1992 | (JP) . |
| 5-345419 | 12/1993 | (JP) . |
| 6-40040 | 2/1994 | (JP) . |
| 7290714 | 10/1995 | (JP) . |
| 7276629 | 11/1995 | (JP) . |

OTHER PUBLICATIONS

European Search Report (in English) completed Dec. 1, 1999 and issued Dec. 9, 1999 in a related application.
Patent Abstracts of Japan, vol. 14, No. 563 (M–1058), Dec. 14, 1990 (1990–12–14) & JP 02 239939 A (NEC Corp), Sep. 21, 1990 (1990–09–21) *abstract*.
Patent Abstracts of Japan, vol. 1995, No. 3, Apr. 28, 1995 (1995–04–28) & JP 06 340071 A (Sharp Corp), Dec. 13, 1994 (1994–12–13) *abstract*.

* cited by examiner

*Primary Examiner*—N. Le
*Assistant Examiner*—Michael Nghiem
(74) *Attorney, Agent, or Firm*—Ostrolenk, Faber, Gerb & Soffen, LLP

(57) ABSTRACT

A print head for an ink jet printer of the present invention includes a plurality of nozzles for ejecting ink, an ink passage fluidly communicated to the nozzles, and a filter disposed in the ink passage. The ink passage has a hydrophobic wall upstream of the filter and a hydrophilic wall downstream of the filter. The print head is capable of reducing the deposition of bubbles on a nozzle portion and thereby insuring desirable printing free from defective ink ejection.

10 Claims, 2 Drawing Sheets

PRINT HEAD FOR AN INK JET PRINTER

BACKGROUND OF THE INVENTION

The present invention relates to an ink jet printer and more particularly to a print head for an ink jet printer including an ink passage whose wall is treated to obviate defective ink ejection.

It is a common practice with an ink jet printer to provide its ink passage with a hydrophilic wall for promoting the flow of ink and bubbles contained in the ink. Japanese Patent Laid-Open Publication No. 7-276629, for example, proposes to implement hydrophilicity by causing ozone with a preselected concentration to flow through the ink passage. Japanese Patent Laid-Open Publication No. 7-290714 teaches that an aqueous solution of an organic emulsion is circulated through the ink passage and then dried.

The above hydrophilicity of the wall of the ink passage is directed toward high wettability of the ink passage, i.e., smooth flow of the ink and bubbles contained therein. This kind of scheme allows a minimum of bubbles to remain in the ink passage and obstruct ink ejection when the ink passage is filled with the ink.

However, after the ink passage has been filled with the ink, a small amount of bubbles sometimes intermittently flow from, e.g., a cartridge upstream of the ink passage into the passage while the printer is in operation. Such bubbles would reach nozzles and render ink ejection from the nozzles defective. Moreover, should the bubbles gather on a filter and form a film thereon, they would increase resistance to the flow of the ink and obstruct ink feed into the head, also resulting in defective ink ejection.

Technologies relating to the present invention are also disclosed in, e.g., Japanese Patent Laid-Open Publication Nos. 4-173345, 5-345419, and 6-40040.

SUMMARY OF THE INVENTION

It is therefore an object of the present invention to provide a print head for an ink jet printer including an ink passage whose wall is treated to obviate defective ink ejection for thereby enhancing printing quality and reliability.

In accordance with the present invention, a print head for an ink jet printer includes a plurality of nozzles for ejecting ink, an ink passage fluidly communicated to the nozzles, and a filter disposed in the ink passage. The ink passage has a hydrophobic wall upstream of the filter and a hydrophilic wall downstream of the filter. If desired, the ink passage may have a part upstream of the filter formed of a hydrophobic resin and a part downstream of the filter formed of a hydrophilic resin.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
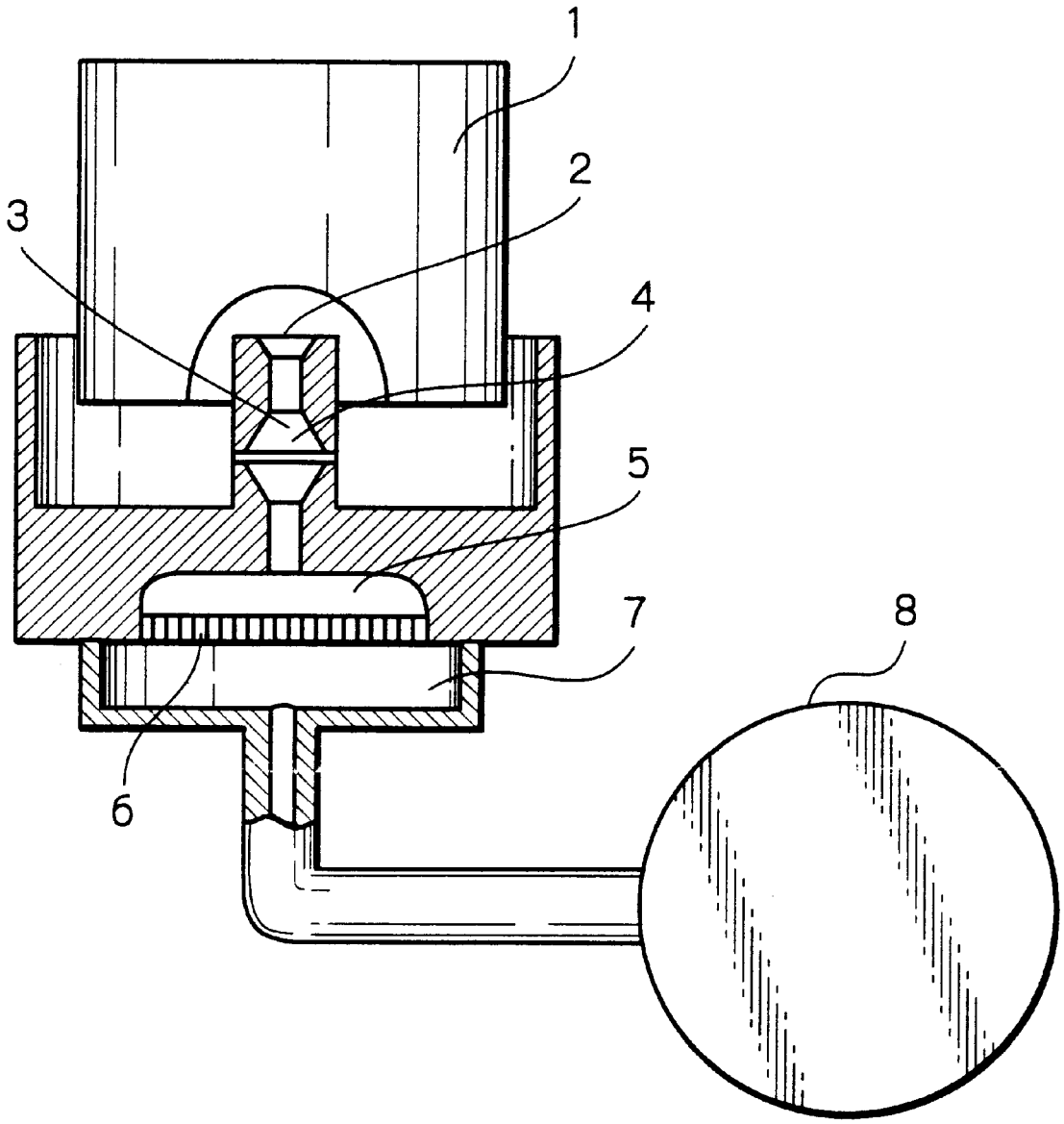
FIG. 1 is a view showing a print head for an ink jet printer embodying the present invention.

Referring to FIG. 1 of the drawings, a print head for an ink jet printer embodying the present invention is shown. As shown, the print head includes a joint portion 2 to which a cartridge 1 storing ink is removably connected. An ink passage extends from the joint portion 2 and includes a bubble collecting portion 3. The bubble collecting portion 3 has a greater sectional area than the other portion of the ink passage. A filter is disposed in the bubble collecting portion 3 and implemented by, e.g., a metallic mesh. A common ink chamber 5 is communicated to the bubble collecting portion 3. A nozzle portion 6 has a plurality of pressure chambers therein.

When a pump 8 is operated, it sucks the ink stored in the cartridge 1 into the print head via a cap 7. Specifically, the ink is fed from the cartridge 1 to the joint portion 2 and then flows into the bubble collecting portion 3 via an upstream path 3*a* (see FIG. 2) upstream of the filter 4. The ink flows from the bubble collecting chamber 3 to the common chamber 5 via the filter 4 and a downstream path 3*b* (see FIG. 2) downstream of the filter 4 and then to the nozzle portion 6.

Figure 2:
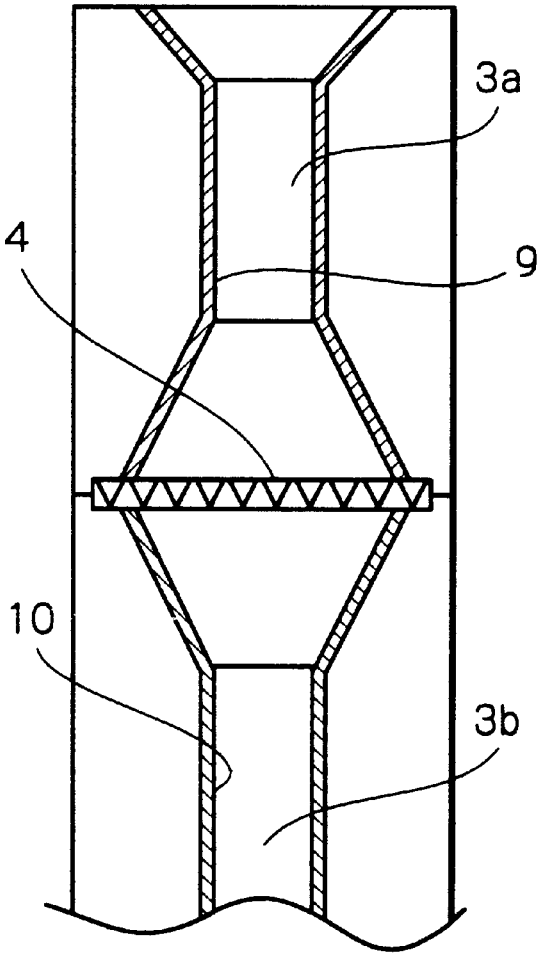
FIG. 2 is a fragmentary enlarged section of the illustrative embodiment.

In the illustrative embodiment, the maximum sectional area of the bubble collecting portion 3, i.e., the effective sectional area of the filter 4 is about ø4 to ø6 while the upstream path 3*a* and downstream path 3*b* each have a sectional area of about ø1. As shown in FIG. 2, the wall extending from the upstream path 3*a* to the filter 4 and the wall extending from the filter 4 to the downstream path 3*b* each are provided with a smooth continuous surface. In the illustrative embodiment, the filter 4 is implemented by a metallic mesh having a mesh size of 1,500 to 2,400 mesh/inch.

As shown in FIG. 2, the ink passage is formed by two separate members positioned on both sides of the filter 4. A hydrophobic film 9 and a hydrophilic film 10 are respectively formed on the surfaces of the two members. Such two members are combined with the intermediary of the filter 4 so as to form the bubble collecting portion 3.

Specifically, before assembly, the inside surfaces of the joint portion, upstream path 3*a* and upstream part of the bubble collecting portion 3 are subjected to hydrophobic treatment using, e.g., a fluoric solvent in order to form a hydrophobic film 9. Also, the inside surfaces of the downstream part of the bubble collecting portion 3, downstream path 3*b*, common ink chamber 5 and nozzle portion 6 are subjected to hydrophilic treatment in order to form a hydrophilic film 10. Subsequently, the two members separate from each other are bonded together by heat with the intermediary of the filter 4, thereby forming the ink passage. Of course, bonding using heat for connecting the two members may be replaced with adhesion using adhesive or solvent or even with ultrasonic deposition.

In the above configuration, even when bubbles intermittently flow from the cartridge 1 into the bubble collecting portion 3 during printing, they float in the portion 3 due to buoyancy and gather on the hydrophobic wall of the upstream part of the ink passage. This successfully prevents the bubbles from reaching the nozzle portion 6 via the filter 4; otherwise, the bubbles would gather on the nozzle portion 6 and would thereby render ink ejection defective. The illustrative embodiment therefore insures stable printing quality.

Figure 3:
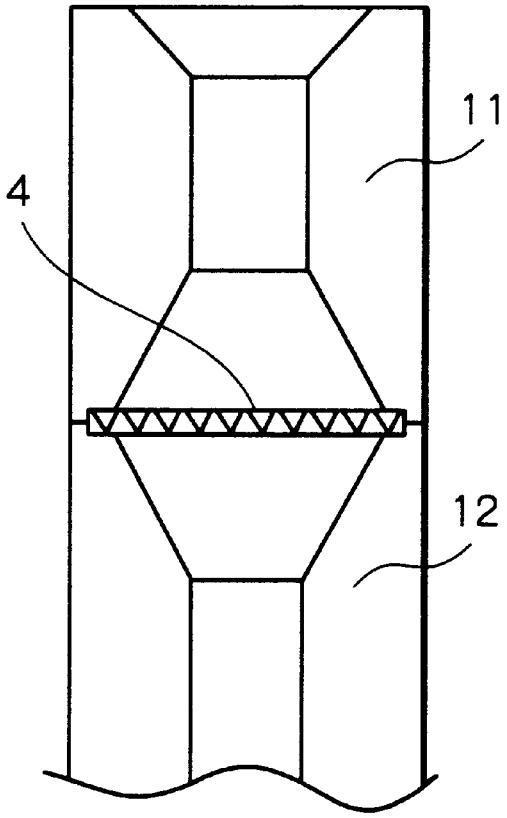
FIG. 3 is a view similar to FIG. 2, showing a modified form of the illustrative embodiment.

FIG. 3 shows a modified form of the illustrative embodiment. As shown, the upstream path 3*a* and upstream part of the bubble collecting portion 3 are implemented as a single molding of fluorocarbon resin, polyethylene (PE), polypropylene (PP) or similar hydrophobic resin 11. The downstream part of the bubble collecting portion 3, downstream path 3*b,* common ink chamber 5 and nozzle portion 6 is also implemented as a single molding of nylon resin, polyvinyl alcohol resin or similar hydrophilic resin 12. The two moldings are bonded by heat or otherwise connected together with the intermediary of the filter 4, as in the above embodiment.

In the modified configuration, bubbles that flow from the cartridge 1 into the bubble collecting portion 3 also float in the portion 3 due to buoyancy and gather on the surface of the hydrophobic resin 11 forming the upstream part of the ink passage. This is also successful to achieve the advantage described in relation to the illustrative embodiment.

Generally, a piezoelectric element varies its volume when a voltage is applied thereto. In the illustrative embodiment, the print head includes small chambers restricted at opposite ends thereof. When any one of the small chambers is compressed by the associated piezoelectric element, the ink is ejected from the restricted end of the chamber in the form of a drop.

As stated above, in the illustrative embodiment, the ink passage formed in the print head includes the bubble collecting portion 3 having a smooth continuous surface and greater in sectional area than the other part of the ink passage. The metallic mesh or similar filter 4 is disposed in the bubble collecting portion 3. The upstream part and downstream part of the ink passage with respect to the filter 4 are respectively subjected to hydrophobic treatment and hydrophilic treatment or respectively bodily formed of hydrophobic resin and hydrophilic resin. It follows that the flow rate of bubbles flowing from the cartridge 1 into the bubble collecting portion 3 is low enough for the bubbles to float due to buoyancy. This allows the bubbles to easily gather on the surface of the hydrophobic part of the ink passage.

Moreover, the filter 4 itself serves to stop the bubbles and prevents them from reaching the part of the ink passage downstream of the filter 4 or the nozzle portion 6. In addition, the hydrophilic surface downstream of the filter 4 allows a minimum of bubbles to deposit thereon. The bubbles can therefore be easily removed from the print head.

The piezoelectric elements used to drive the print head may be replaced with electrothermal transducers, if desired.

In summary, it will be seen that the present invention provides a print head for an ink jet printer capable of reducing the deposition of bubbles on a nozzle portion and thereby insuring desirable printing free from defective ink ejection. This advantage is derived from a unique configuration in which an ink passage has a hydrophobic wall upstream of a filter and a hydrophilic wall downstream of the filter.

Various modifications will become possible for those skilled in the art after receiving the teachings of the present disclosure without departing from the scope thereof.

What is claimed is:

1. A print head for an ink jet printer, comprising:

a nozzle for ejecting ink;

an ink passage in fluid communication with to said nozzle; and a filter disposed in said ink passage;

said ink passage having a hydrophobic wall upstream of said filter and a hydrophilic wall downstream of said filter.

2. A print head as claimed in claim 1, wherein a portion of said ink passage around said filter has a greater sectional area than portions of said ink passage upstream and downstream of said filter.

3. A print head as claimed in claim 1, wherein said hydrophobic wall is formed by hydrophobic treatment using a fluoric solvent.

4. A print head for an ink jet printer, comprising:

a nozzle for ejecting ink;

an ink passage in fluid communication with to said nozzle; and a filter disposed in said ink passage;

said ink passage having a part upstream of said filter formed of a hydrophobic resin and a part downstream of said filter formed of a hydrophilic resin.

5. A print head as claimed in claim 4, wherein a portion of said ink passage around said filter has a greater sectional area than portions of said ink passage upstream and downstream of said filter.

6. A print head as claimed in claim 4, wherein the hydrophobic resin comprises a fluorocarbon resin.

7. A print head as claimed in claim 4, wherein the hydrophobic resin comprises polyethylene.

8. A print head as claimed in claim 4, wherein the hydrophobic resin comprises polypropylene.

9. A print head as claimed in claim 4, wherein the hydrophilic resin comprises nylon resin.

10. A print head as claimed in claim 9, wherein the hydrophilic resin comprises a polyvinyl alcohol resin.

* * * * *